US005692528A

United States Patent [19]

Brenn-Albertoni

[11] Patent Number: 5,692,528

[45] Date of Patent: Dec. 2, 1997

[54] HAIR CURLER FOR FORMING NATURAL WAVING OF HAIR

[76] Inventor: Gemma Brenn-Albertoni, Via C. Ghiringhelli 55, CH-6500 Bellinzona, Switzerland

[21] Appl. No.: 584,126

[22] Filed: Jan. 11, 1996

[30] Foreign Application Priority Data

| | | | |
|---|---|---|---|
| Jan. 11, 1995 | [CH] | Switzerland | 00 066/9506 |
| Jun. 6, 1995 | [EP] | European Pat. Off. | 95108609.9 |

[51] Int. Cl.[6] ..... A45D 2/20

[52] U.S. Cl. ..... 132/247; 132/262; 132/250

[58] Field of Search ..... 132/246, 247, 132/262, 265, 250

[56] References Cited

U.S. PATENT DOCUMENTS

| | | | |
|---|---|---|---|
| 1,346,920 | 7/1920 | Steinacher | 132/247 |
| 2,507,356 | 5/1950 | Steiner et al. | 132/247 |
| 2,525,981 | 10/1950 | Webster | 132/246 |
| 2,549,446 | 3/1951 | Frishberg . | |
| 3,079,933 | 3/1963 | Solomon | 132/250 |
| 3,204,646 | 9/1965 | Chamberlin | 132/250 |
| 3,267,942 | 8/1966 | Mestral | 132/262 |
| 3,718,144 | 2/1973 | Jennis . | |
| 4,572,221 | 2/1986 | Barradas | 132/246 |
| 4,809,719 | 3/1989 | Holman | 132/250 |
| 5,144,968 | 9/1992 | Rivera | 132/247 |

FOREIGN PATENT DOCUMENTS

| | | | |
|---|---|---|---|
| 404163 | 12/1990 | European Pat. Off. | 132/246 |
| 687 623 | 9/1930 | France . | |
| 705 559 | 6/1931 | France . | |
| 1 248 464 | 3/1961 | France . | |
| 1 414 913 | 1/1965 | France . | |
| 2 382 212 | 9/1978 | France . | |
| 2 503 996 | 10/1982 | France . | |
| 449 542 | 2/1928 | Germany . | |

*Primary Examiner*—Todd E. Manahan

*Attorney, Agent, or Firm*—Millen, White, Zelano, & Branigan, P.C.

[57] ABSTRACT

A hair curler with an aerated, elastic and elongated body for setting waves in wet, damp or dry hair; the aerated and elastic body is covered in whole or in part by an aerated elastic sheath provided in its-central part with protruding filament-like elements to facilitate winding hair onto the curler. The ends of the curler body are fitted with interlocking elements which allow the curler to be locked into a circular or semi-circular shape after the hair has been wound onto it.

11 Claims, 2 Drawing Sheets

HAIR CURLER FOR FORMING NATURAL WAVING OF HAIR

BACKGROUND OF THE INVENTION

Field of the Invention

The present invention relates to hair curlers in general and in particular to a type of curler which grips the hair while facilitating winding the same onto it to produce waves that look natural and are not uni-directional.

Aerated hair curlers which grip the hair to facilitate rolling and setting the same are already known in the art. Such hair curlers have good aeration and grip characteristics, but they do not allow a large quantity of hair or very long hair to be wound onto them and they can only produce uni-directional waves.

There are also curlers in the form of long cylindrical rollers made of foam-rubber with a flexible metal core. They are fixed to the head by bending the extremities into a U-shape after the hair has been wound on to them. Due to their nature, these curlers cannot be aerated and accordingly they must be usually used with dry or slightly damp hair, and the "natural" waves have no real consistency.

There are also curlers formed of metal springs covered by a soft fabric; after the hair has been wound onto them, these rollers are affixed to the head by bending them back on themselves up to obtain a circle and clipping the two extremities together by means of shaped interlocking parts. These curlers allow natural, non uni-directional waves to be formed, differently from the traditional curlers. However, they are not aerated either, and can be used only on dry or slightly damp hair. Furthermore, their surface is usually smooth, making it difficult to wind hair (especially short hair) on; it is also not easy to wind large quantities of hair onto such rollers. Other types of roller similar to the described ones suffer from similar drawbacks.

OBJECTS OF THE INVENTION

The present invention overcomes these drawbacks and provides an extremely aerated curler which facilitates winding on the hair and gripping it in such a way as to produce natural and not uni-directional waves, as well as corkscrew-shaped hair or waves limited at the free terminal part of the hair.

SUMMARY OF THE INVENTION

The curler according to the present invention is of the type comprising an elongated, cylindrical body which can be bent back on itself form a position in which its axis is rectilinear to a position in which it forms a closed ring or a semicircle, and carrying at its ends attachment means to maintain such last position, characterized in that said cylindrical body is hollow and aerated and in that hair retaining elements project in an essentially radial direction in at least one area of its length. The present invention will now be described in more detail with reference to preferred embodiments given only as illustrative and therefore not limiting examples, as shown in the attached drawings, in which:

DESCRIPTION OF THE PREFERRED EMBODIMENTS

Figure 1:
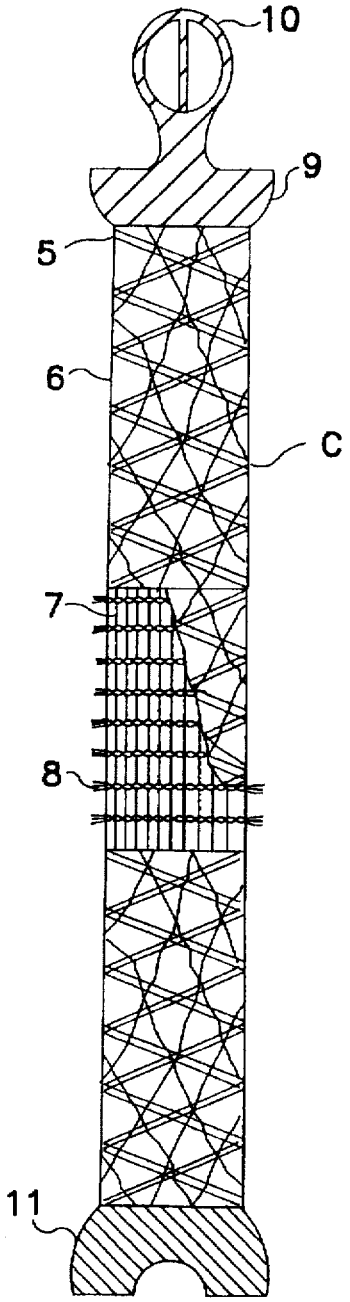
FIG. 1 is a view with parts in section of a first embodiment of the curler.

As it can be seen from FIG. 1, in which a partly cutaway curler is shown, a curler cylindrical body C is formed by helically wound strips 5, which cross over and are mutally fixed at their crossing points, to form a very aerated and flexible support. This support is covered by a net sheath 6, which prevents the hair from getting between the helical elements 5. Around the central part of the curler an aerated, flexible fabric 7 is wound, said fabric carrying filament-like protruding elements 8 to grip the hair. Such filament-like elements 8 project in a substantially radial direction from the aerated fabric 7. A male snap-locking element 9 (formed by a series of plastic strips 10 which join together to form a very elastic helissoidic body) projects from one end of the curler. At the other end of the curler a ring 11 forms the female part of a snap lock. The male element 9, when it is inserted with its elastic strips 10 into the ring 11 at the other end of the curler, closes and locks the curler in the form of a closed circle after the hair has been wound on it, as it can be seen from FIG. 2.

Figure 2:
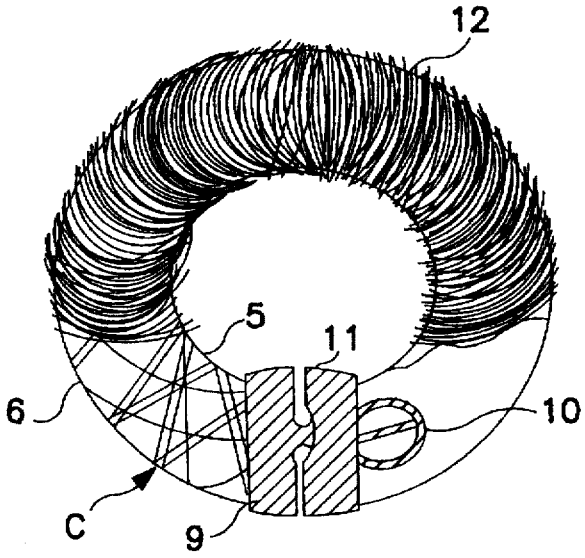
FIG. 2 is a view of the curler of FIG. 1 when fixed in position after the hair has been wound onto it.

FIG. 2 shows, in a view of the curler of FIG. 1 with cutway parts, the strips 10 of the male element 9 snap-locked inside the female locking ring 11 of the body C after the hair 12 has been wound on it. The two ends of the curler remain locked together holding the curler in place, due to the resilience of the elastic strips 10.

Figure 3:
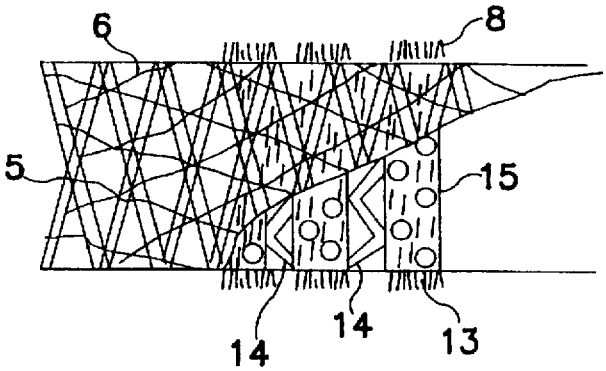
FIG. 3 is a cutaway view with parts in section of the curler, showing in its interior a support element for means to grip the hair, which projects through the curler body and sheath.

FIG. 3 shows a partially cutaway view of another embodiment of the present invention. The area presenting the filament-like protruding elements 8 has tubular inserts 13 with zig-zag connecting elements 14 - which make the inserts flexible and holes 15 which aerate the same, said tubular inserts 13 being equipped with hair-gripping elements 8 projecting between the helical parts 5 forming the basic structure of the curler, and projecting also through the overlying net sheath 6.

Figure 4:
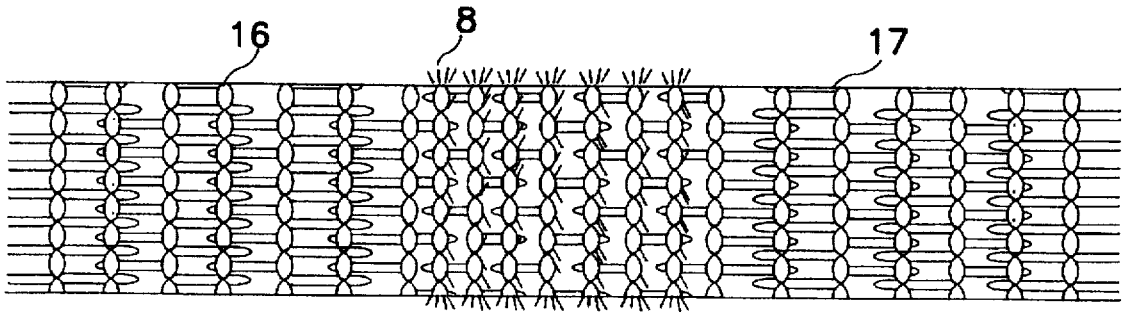
FIG. 4 is a plan view of a portion of a material used to cover the curler body according to an embodiment of the present invention.

FIG. 4 shows a material used to form the sheath of a curler according to the present invention. It is formed by lines of chain-links 16 held by keeper-rings 17 which slide between the interstices of the chain-links 16 to warrant a highly flexible structure. Some of the central chain-links 16 have filament-like protruding elements 8 which grip the hair and facilitate winding it on.

Figure 5:
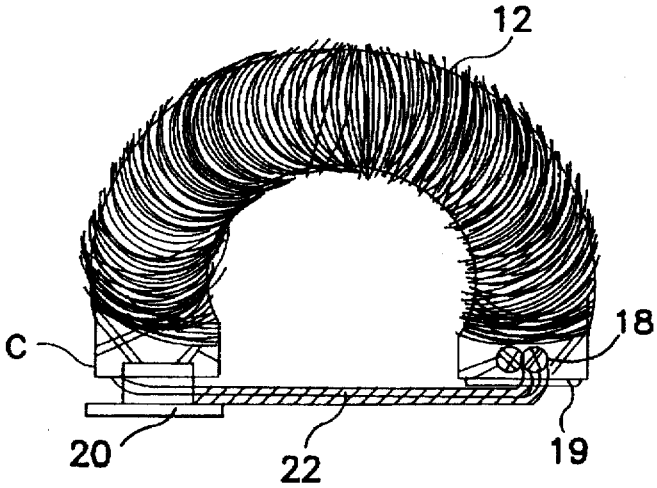
FIG. 5 is a view of a curler fixed in the form of a semicircle after the hair has been wound onto it.

FIG. 5 shows another embodiment of the present invention in which the curler is maintained in a semi-circular shape after the hair 12 has been wound on. The curler is held in the desired position by an elastic or rigid band 22 retained by a knot 18, or a mobile or rotatable ball, in a cap 19 inserted into one end of the curler and hooked over the element 20 inserted into the other end of the curler hollow body C.

Besides the embodiments described above, the hollow body C of the curler according to the present invention can be formed according to many further embodiments; it could be formed by a spiral-shaped spring or by a rigid central ring and two flexible side parts, or by strips of a flexible plastic material inserted into a sheath, or it may be formed in whole or in part of articulated aerated sections. The hollow body could also be formed by bellows with aeration holes in it.

The filament-like hair-gripping elements 8, instead of being carried by a flexible aerated fabric 7, could project directly from the body C of the curler, or they could be woven directly into the elastic sheath. Furthermore, the sheath which covers the body C of the curler could comprise a net of rough and "rubbery" material, to facilitate winding the hair onto it.

The curling attachment means to maintain the same in its curved position could be carried-out according to different designs: they could be rigid locking pieces or could be attached to the body C of the curler by bellows which could lengthen or shorten the curler as needed. The curler could also be kept in the required shape by a bar or a unextendable or elastic element which connect the two ends of the same.

From the foregoing it appears that large quantities of long hair can be wound onto the curler according to the present invention to produce naturally-shaped hair waves due to the circular or semi-circular form assumed when the curler is retained on the head. The curler is particularly suited to wet hair due to the high level of aeration made possible, so that the hot air from an hair-drier can circulate freely and thus the waves setting times are short. The setting time is also reduced by the fact that the filament-like elements comb the hair and facilitate winding it onto the curlers. Hairstyles which have been set using the curlers according to the present invention look modern and naturally waved. The curlers can be used to give a last-minute curl to the ends of hair that has already been put up.

I claim:

1. A hair curler for producing natural waving of hair, the hair curler having a cylindrical shape with a curler central portion equally spaced from the ends of the hair curler, the improvement comprising:

an aerated, hollow and elongated cylindrical body defining an inner cavity and formed by at least two helical, counter-wound strips crossing each other and mutually fixed at their crossing points, said body being constructed and arranged to be bent back on itself from a position in which its axis is rectilinear to a position in which it forms a circular closed ring;

filament-like elements projecting in a substantially radial direction from said curler central portion; and attachments at the ends of said cylindrical body to maintain it in the form of a closed ring.

2. A curler according to claim 1, wherein said filament-like elements project from an aerated flexible fabric placed in said curler central portion.

3. A curler according to claim 2, characterized in that said sheath covering said aerated, hollow cylindrical body is formed by a knitted material obtained by lines of chain-links and keeper-rings which run in the spaces between said chain-links.

4. A curler according to claim 2, characterized in that said sheath covering said aerated, hollow cylindrical body is in the form of a rough, "rubbery" material to facilitate winding hair onto it.

5. A cutler according to claim 1, wherein said aerated, hollow cylindrical and elongated body is covered over at least a potion by an aerated elastic sheath formed by a knitted material obtained by lines of chain-links held by keeper-rings, said keeper-rings being slidable between said chain-links; and wherein said filament-like elements are woven directly into said aerated elastic sheath.

6. A cutler according to claim 1, wherein said filament-like elements project from a flexible aerated supporting element placed in the inner cavity of said aerated, hollow cylindrical body.

7. A curler according to claim 1, wherein said filament-like elements directly project from said aerated, hollow cylindrical body.

8. A curler according to claim 1, wherein said attachments comprise snap-locking elements having a male part at one end of said cylindrical body and a female part at the other end of said cylindrical body.

9. A curler according to claim 8, wherein said attachments have a diameter at least substantially equal to the diameter of said cylindrical body.

10. A curler according to claim 8, wherein said attachments have a diameter greater than the diameter of said cylindrical body.

11. A curler according to claim 1, wherein bellows elements are inserted between said central portion and said attachments in order to allow for a lengthening or shortening of said curler as required.

* * * * *